United States Patent [19]

Meuller

[11] 4,386,705

[45] Jun. 7, 1983

[54] ICE CREAM CARTON

[75] Inventor: David C. Meuller, Ashland, Ohio

[73] Assignee: James River-Dixie/Northern, Inc., Greenwich, Conn.

[21] Appl. No.: 228,597

[22] Filed: Jan. 26, 1981

[51] Int. Cl.[3] ..... B65D 5/54; B65D 5/66

[52] U.S. Cl. ..... 206/626; 206/624; 206/609; 206/611; 206/613; 229/DIG. 5

[58] Field of Search ..... 206/626, 624, 609, 613, 206/611; 229/DIG. 5

[56] References Cited

U.S. PATENT DOCUMENTS

| | | | |
|---|---|---|---|
| 2,038,893 | 4/1936 | Davidson | 206/624 |
| 2,973,086 | 2/1961 | Thompson | 206/626 |
| 3,040,959 | 6/1962 | Killion | 206/624 |
| 3,281,055 | 10/1966 | Buttery et al. | 206/624 |
| 3,833,165 | 9/1974 | Hoiles | 206/624 |
| 3,951,333 | 4/1976 | Forbes, Jr. et al. | 206/624 |
| 3,980,224 | 9/1976 | Yasuda | 229/DIG. 5 |
| 3,981,434 | 9/1976 | Ramich | 229/51 |
| 4,046,313 | 9/1977 | Perry | 206/624 |
| 4,200,200 | 4/1980 | Hein et al. | 221/48 |
| 4,245,743 | 1/1981 | Heuberger | 206/611 |
| 4,260,061 | 4/1981 | Jacobs | 206/626 |

FOREIGN PATENT DOCUMENTS

| | | | |
|---|---|---|---|
| 2032393 | 5/1980 | United Kingdom | 229/DIG. 5 |

*Primary Examiner*—Stephen P. Garbe

*Attorney, Agent, or Firm*—Harry W. Hargis, III

[57] ABSTRACT

A carton incorporates a new product release film into its tear strip, and greatly improves performance of the tear strip. The release film is uniaxially oriented, and is aligned with the tear strip, thus controlling tear strip function. Weakening cuts in the paperboard of the tear strip can now be significantly modified for manufacturing efficiencies, while the composite tear strip has enhanced performance and reliability.

6 Claims, 6 Drawing Figures

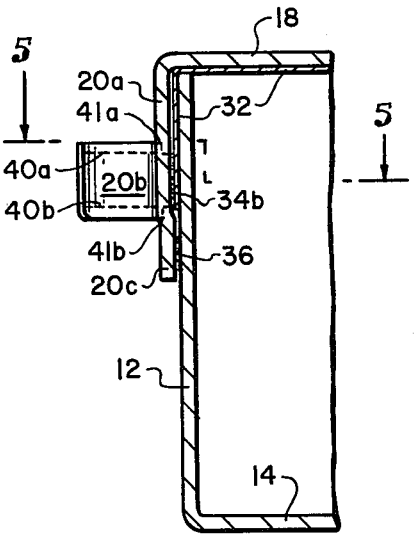
FIG.3
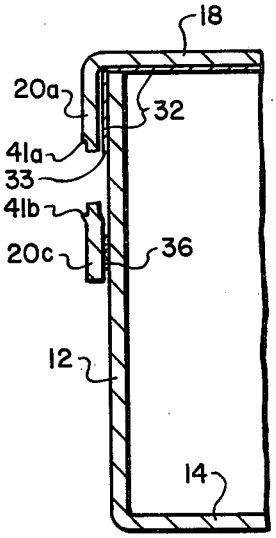
FIG.4
FIG.5
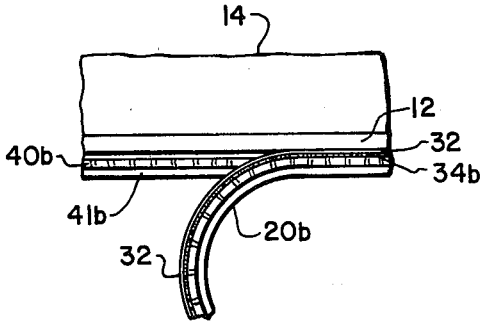
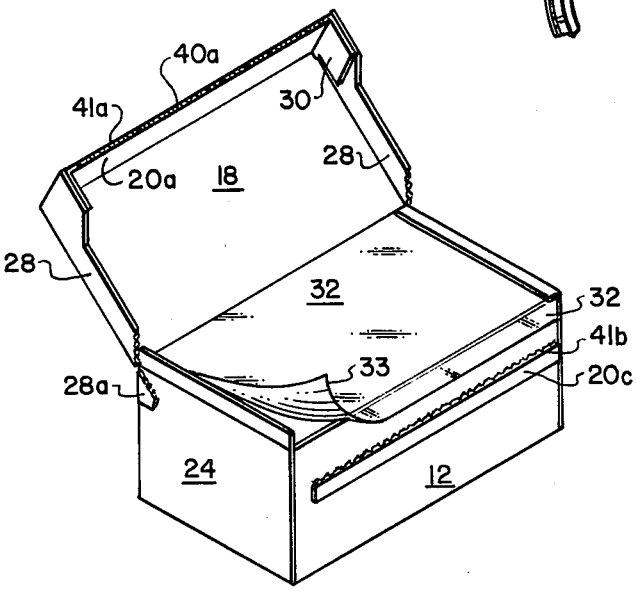
FIG.6

ICE CREAM CARTON

BACKGROUND OF THE INVENTION

Ice cream and similar frozen dessert items are packaged in a semi-frozen state in which the product has sufficient fluidity to flow and conform to the carton. During hard freezing of the product to the state the customer normally associates with product of this type, the ice cream tends to form rather firm bonds to the various interior surfaces of the paperboard carton in which it is packaged. Prior art cartons have a variety of designs of tear strips. One carton incorporates into its design both a tear strip, and a release film on the interior of the top cover panel, and underlying the tear strip, to improve the characteristic release of the top cover panel from the contents when the top cover panel is opened to expose the product. In that carton, the release film is released from the tear strip when the tear strip is removed.

In actual practice, paperboard tear strips such as those shown in the prior art have presented substantial difficulty to both the carton manufacturer and the carton user. The paperboard carton manufacturer desirably makes the lines of weakness on the tear strip as strong as possible so that they survive the manufacturing process without tearing. The carton user desires the lines of weakness on the tear strip to be as weak as possible, to assure easy and complete tearing along the entire length of the tear strip.

In cartons of the prior art, the result is a compromise. The lines of weakness are made strong enough to satisfy manufacturing needs, and desirably weak enough to satisfy the customer. Sadly, the number of paperboard tear strips that fail to operate properly is unacceptably high. Those which are too weak, fail in the manufacturer's factory and are discarded. Those which are too strong typically are not detected until the user finds that they fail to tear along the entire length of the tear strip when the carton is first opened. It is not uncommon for the tear strip to properly initiate the tear along the lines of weakness, and then fail internally, leaving part of the tear strip intact on the carton.

It is an object of this invention to provide improved opening means for paperboard packaging structure.

It is a further object to provide a tear strip which is easily manufactured in such a configuration that the tear strip reliably tears along its entire length.

SUMMARY OF THE INVENTION

The invention is embodied in package structure made of packaging material of the type using paperboard as a component of the material, and enclosing a product in the package. The package structure has an easy opening tear strip, with a length of paperboard along the length of the tear strip, the length of paperboard having a width greater than the width of the tear strip, and a length of uniaxially oriented polymer film extending the entire length of the tear strip and underlying the length of paperboard. The film is secured against substantial lateral movement with respect to the width of the length of paperboard.

The film is uniaxially oriented to the extent that it exhibits tensile strength in the orientation direction that is substantially greater than the tensile strength in the direction perpendicular to the orientation direction. The film has a with-grain to cross-grain tensile strength ratio greater than 1.5 to 1, and a maximum elongation in both with-grain and cross-grain directions of no more than 150%.

The with-grain direction of the film is aligned with the length of the tear strip.

In this structure, the film strengthens the tear strip to facilitate its complete removal, and controls the direction of tearing of the tear strip.

Normally, the width of the length of paperboard extends on both sides of the tear strip, the film is secured by overall surface affixation to the length of paperboard and the tear strip has cuts at one end, along its side edges, in the paperboard and extending along the tear strip from the one end. In an especially preferred embodiment, the length of paperboard has an intermittent cut line on each side edge of the tear strip, extending along its length, aligned with the cuts at the one end, and substantially aligned with the with-grain direction of the film.

The tear strip of this invention is advantageously used, for example, in a paperboard carton for ice cream comprising a front wall, a bottom wall, a rear wall, opposed end walls and a top cover panel hingedly attached along one edge to the upper edge of the rear wall and having a front cover panel hingedly attached to the opposite edge of the top cover panel and overlapping the upper portion of the front wall when the carton is erected. The film of uniaxially oriented polymer is affixed along one of its edges to the interior surface of the rear wall. The film extends to substantially completely cover the interior surface of the top cover panel and is affixed to the inner surface of the front cover panel, the affixation on the front cover panel being strong at normal frozen food temperatures.

BRIEF DESCRIPTION OF THE DRAWINGS

FIG. 3 is a cross-section taken at 3—3 in FIG. 2, showing the tear strip in place on the erected carton.

FIG. 4 is a cross-section taken at 4—4 in FIG. 2, showing the tear strip displaced.

FIG. 5 is taken at 5—5 in FIG. 3 and shows a top view of a section of the tear strip.

FIG. 6 is a perspective view of a carton with the tear strip removed, the cover open, and the plastic film partially lifted.

DETAILED DESCRIPTION OF THE ILLUSTRATED EMBODIMENT

Figure 1:
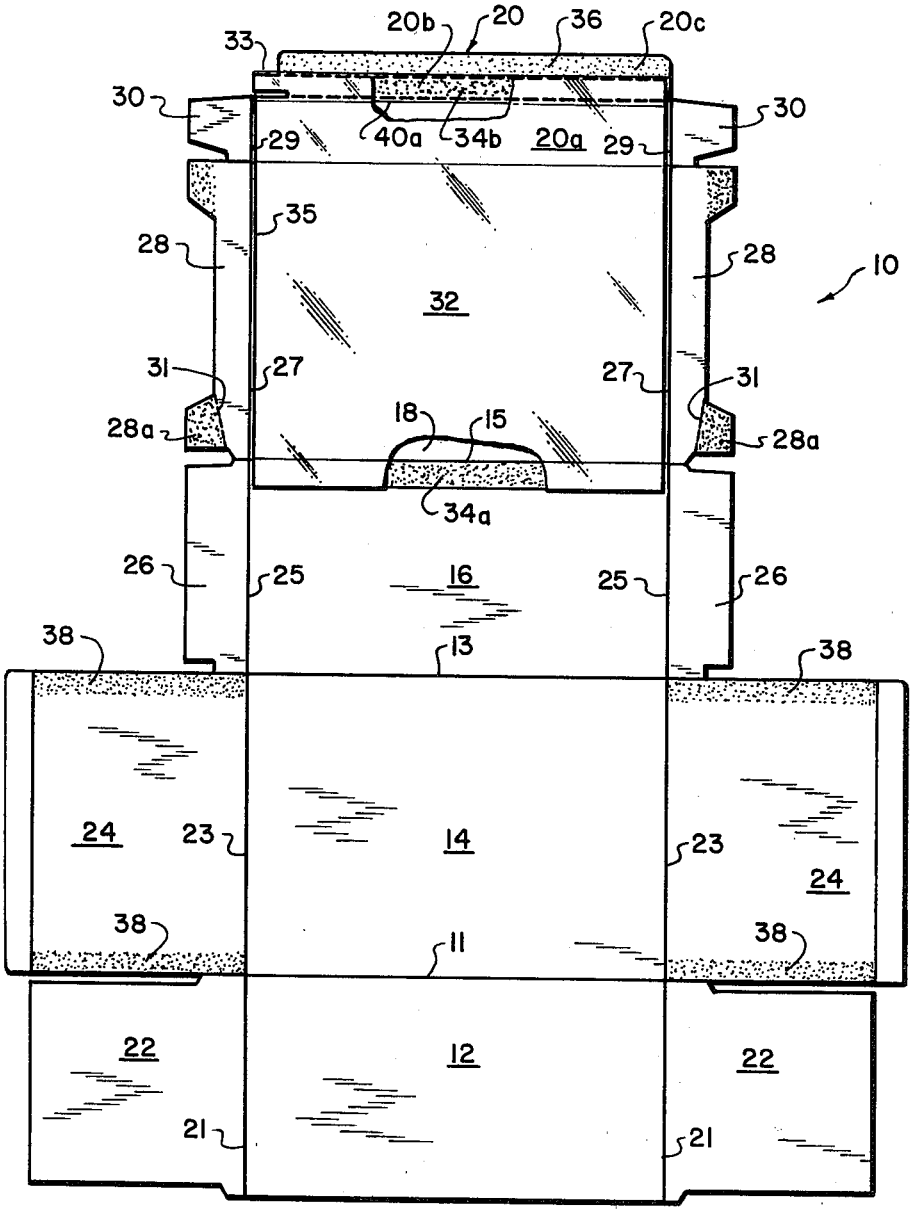
FIG. 1 is a plan view of the interior surface of a carton blank in accordance with a preferred form of the invention.
Figure 2:
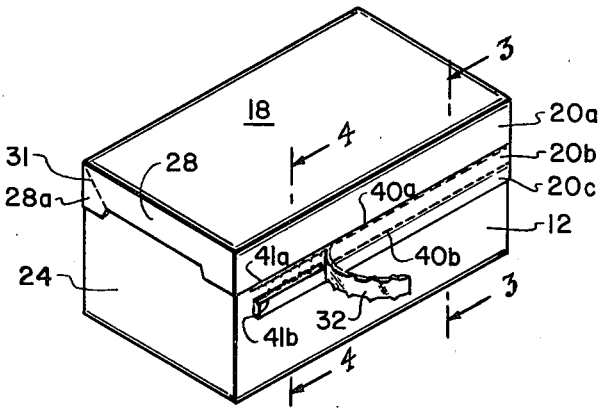
FIG. 2 is a perspective view of a sealed carton with the tear strip partially removed.

The invention is most easily understood in terms of its relationship to a paperboard carton. FIG. 1 shows a blank 10 of a preferred carton using the tear strip of the invention. The blank is formed of a single piece of paperboard which is suitably cut and scored to form, hingedly attached in sequence along parallel hinge score lines 11, 13, 15 and 17 respectively, a receptacle front wall 12, bottom wall 14, rear wall 16, a top cover panel 18 and a front cover panel 20. The front cover panel 20 is comprised of three portions, an upper front cover panel portion 20*a*, an intermediate tear strip portion 20*b*, and a lower or remote bonding portion 20*c*, portions 20*a*, 20*b* and 20*c* being separated by intermittent cut lines 40*a* and 40*b*.

Hingedly connected to opposite end edges of front wall 12 along score lines 21 are opposed receptacle front inner end wall panels 22. Hingedly attached to opposite end edges of the bottom wall 14 along score lines 23 are opposed receptacle bottom outer end wall panels 24. Hingedly attached to opposite end edges of rear wall 16 along score lines 25 are opposed rear inner end wall panels 26. Hingedly attached to the opposite end edges of top cover panel 18 along hinge lines 27 are cover end skirt panels 28, and hingedly attached to the opposite end edges of the front cover panel portion 20*a* of the front cover panel 20 along score lines 29 are corner glue tabs 30.

A liner sheet of a uniaxially oriented polymer film 32, substantially equal in width to the distance between the paired score lines 25—25, 27—27 and 29—29 is adhered to the inner surface of the receptacle rear wall 16 by adhesive at 34*a*, positioned a short distance below the hinge line 15 on the receptacle rear wall 16. Film 32 extends across the top cover panel 18, across the upper front cover panel portion 20*a* and is adhered to the inner surface of the intermediate tear strip portion 20*b* with adhesive at 34*b*. Its with-machine orientation direction is aligned with intermittent cut lines 40*a* and 40*b*.

Cover end skirt panels 28 have an adhesion area 28*a* at the lower rear portion of the panels defined by a weakness line 31 which extends from a point on the free edge of skirt panel 28 displaced from hinge line 27 upwardly and rearwardly to a point on the rear edge of panel 28.

In erecting the carton blank into a receptacle, adhesive is applied or activated at selected areas 38 on the inner surface of outer end wall panels 24. The front wall 12 and rear wall 16 are rotated into perpendicular relationship to bottom wall 14. The inner end wall panels 22 and 26 are rotated inward into substantially abutting relationship and outer end wall panels 24 are rotated upward to become engaged by adhesive at 38 with the outer surface of the inner end wall panels 22 and 26, thus completing the erection of the receptacle portion of the carton, which is then ready to be filled with ice cream or similar product.

After filling the receptacle with product, adhesive is applied or activated at areas 28*a* of cover end skirt panels 28, and at the bonding portion 20*c* of the front cover panel 20. Top cover panel 18 is brought into overlying relationship to the product with film 32 in intimate contact therewith, after which the front cover panel 20 is rotated downward to overlie the upper portion of receptacle front wall 12 with bonding portion 20*c* of panel 20 being adhered to front wall 12. Complete sealing of the carton is achieved by infolding the glue tabs 30 to overlie the upper front corner of outer end walls 24 and then downfolding the cover end skirt panels 28 into adhesive superposition on the glue tabs 30 and the upper portion of outer end walls 24.

The carton is opened by removing the tear strip which is comprised of panel portion 20*b* and that portion of film 32 which underlies 20*b*, which will be explained in greater detail hereinafter.

The tear strip, as observed for example in FIG. 1, is a removable portion of a combination of the paperboard lying between intermittent cut lines 40*a* and 40*b* and a portion of the film 32. One edge of the film which forms part of the tear strip is the free edge 33 of the film approximately underlying intermittent cut line 40*b*. The other edge of the film which forms part of the tear strip is not visibly defined in the unopened tear strip, but rather is an integral and uninterrupted portion of the film. As the film is stressed during removal of the tear strip, the splitty nature of the uniaxially oriented film 32 is depended upon to create, at a point of stress on its side edge 35, the initiation of the tear which defines the other edge of that portion of the film which forms part of the tear strip. Once the tear is initiated it is easily propagated along the axis of orientation of the film. It has been observed that the axis of orientation of the film in fact controls the direction of tear of the entire paperboard/film tear strip composition. Thus the presence of intermittent cut lines 40*a* and 40*b* in the paperboard is not entirely necessary, and experiments have shown that the tear strip functions satisfactorily without visibly defined tear lines in the paperboard. However, visibly defined tear lines in the paperboard are normally used. Consumers are accustomed to identifying tear strips with visible lines of weakness. Intermittent cut lines 40*a* and 40*b* serve as visible tear strip indicators. They also provide a neat appearance on the outside surface of the paperboard when the carton is opened, and minimize the free fiber ends adjacent that surface.

To that end, cut score lines 41*a* and 41*b* positively limit the lateral spread of surface tearing of the paperboard on the outer surface, and thus similarly limit the number of free fiber ends on the carton exterior, as well as insuring a neat outer appearance.

In understanding the significance of the invention, it is important to recognize that the tear strip herein described provides a significant increase in the freedom to adjust processing parameters in manufacturing the carton blank, as the compromise in weakness of the tear line in the tear strip is no longer necessary. The strong control of the tear strip provided by the film 32 eliminates the necessity of making lines of weakness such as at 40*a* and 40*b* sufficiently weak to propagate and control the tear by their own physical properties. Rather, they obtain substantial control and propagation properties from film 32. Thus the conventional weak lines of weakness, such as the typical herringbone design is no longer necessary; and stronger weakened lines such as those illustrated at 40*a* and 40*b* may be used. Such lines are entirely satisfactory for manufacturing purposes, as well as for consumer use in the present invention.

Thus is the function of the tear strip improved. The strong tear property in the uniaxially oriented release film 32 enables the user to easily tear it. Its strength in the with-grain direction reinforces the composite tear strip so that the tear strip will tear off without failure. Thus dual functionality of the release film requires that the film underlie the paperboard in the tear strip, and requires removal of a small portion of the release film when the tear strip is removed. The removal, though, does not impair the function of the release film. It only makes it slightly shorter.

To be satisfactory for use in this invention, the film 32 must be capable of a high degree of orientation along a given axis. Such orientation is generally achieved in known manner by compression rolling of the film or by stretching the film linearly between nips or surfaces operating at different speeds. Polyethylene having a specific gravity of greater than about 0.94, usually referred to as high density polyethylene, is of particular utility both for its excellent performance characteristics and also for its economy. Uniaxially oriented high density polyethylene of between 0.5 mil and 1.5 mil thickness is the preferred material for use in this invention.

Of nearly comparable utility are films of homopolymeric polypropylene, polyacrylonitrile, polystyrene and a terpolymer of acrylonitrile, butadiene and styrene. Compolymers of propylene with ethylene, medium density polyethylene, polyvinyl chloride, polyethylene terephthalate and polyamides of the nylon type are also of some utility in this invention, although they are somewhat less satisfactory than high density polyethylene. Films such as low density polyethylene, ethylene vinyl acetate copolymers, ethylene ethyl acrylate copolymers, polybutylene and ionomers of polyethylene have not shown utility in this invention. Depending on the composition of the film selected and the degree of orientation thereof, the optimum film thickness will vary from about 0.25 mil to about 2.0 mil, the generally preferred range being from about 0.5 mil to 1.5 mil thickness.

In general the inherent strength of polymeric material arises from several molecular forces. The overwhelming contribution comes from the covalent bonds along the chain axis of the molecules. Orientation along a single axis results in the predominant alignment of the chain axis of the molecules parallel to the orientation direction, thereby giving great strength in that direction.

Furthermore, the resultant lack of molecules aligned in the direction perpendicular to the direction of orientation results in weak bonds in the transverse direction. The uniaxial orientation of the molecules thus accounts for the very great differences in tear strength between the with-grain axis and the cross-grain axis of the film. It is this difference which gives rise to the linear tearing essential to use of a given film in the present invention. High density polyethylene and other polymers which exhibit relatively high crystallinity have low amounts of amorphous or branched molecules to form cross-grain ties or entanglements. In the uniaxially oriented state, these films will tear linearly under application of a modest amount of tear force, the resulting tear running in the direction of orientation of the film.

The most desirable uniaxially oriented films for use in this invention will tear very easily in the with-grain direction, or parallel to the axis of orientation, whereas it is very difficult to tear the film across the grain, or perpendicular to the axis of orientation.

A convenient indicator of the tear properties of a film is the tensile strength measurement. It has been found that the tensile strength measurement can be relied upon as indicative of the acceptability of performance of any given film in this invention. In order for a film to perform satisfactorily in this invention, it is necessary that the tensile strength, measured in the with-grain direction, be significantly greater than in the cross-grain direction. Generally, the with-grain to cross-grain tensile strength ratio should be greater than 1.5 to 1, and preferably greater than about 4 to 1. The possession of a tensile strength ratio within the desired range is, however, not sufficient to guarantee the satisfactory performance of a film in the invention since it is also necessary that the film be capable of no more than moderate elongation in either the with-grain or the cross-grain direction. That is, the degree by which the film may be stretched in either direction prior to reaching its breaking point must be no more than about 150% of its original length (in other words, no portion of the film may be extended to more than 2.5 times its original length or width before it will tear). Preferably, the film will exhibit no more than a 100% extensibility, especially in the cross-grain direction.

Thus, for example, the preferred high density polyethylene film exhibits a with-grain to cross-grain tensile strength ratio of between 5 to 1 and 6.5 to 1, a cross-grain elongation of between 20% and 50% and a with-grain direction elongation of between 30 and 75%. Therefore, as tearing force is applied to the film to start tearing of the tear strip, the film tends to tear rather than to stretch, since the film is relatively inextensible. Furthermore, since the tensile strength ratio strongly favors film severance in response to tear forces applied in the with-grain direction rather than in response to forces applied in the cross-grain direction, the tear forms and is propagated with the grain, rather than across it, or at a substantial angle to it.

Other uniaxially oriented films which are very satisfactory for use in this invention also exhibit comparable elongation and tensile ratio characteristics. In the following Table 1 are tabulated the maximum elongation values and the with-grain to cross-grain tensile strength ratios of a number of uniaxially oriented films. In each case, the films have been oriented by compression rolling in accordance with the process set forth in U.S. Pat. No. 3,504,075, the degree of orientation being substantially the maximum obtainable by the compression rolling process in each case. The films in Table 1 have been grouped in three categories, ranging from the most satisfactory for use in the present invention to those which have proven to be unacceptable by virture of an unsatisfactory combination of the properties previously mentioned.

TABLE 1

| Film | Tensile Strength Ratio* | Maximum Elongation With-Grain | Maximum Elongation Cross Grain |
|---|---|---|---|
| Most Desirable Films | | | |
| High Density Polyethylene | 5:1 to 6.5:1 | 30–75% | 20–50% |
| Polypropylene (Homopolymer) | 5:1 to 6:1 | 100–150% | 25–150% |
| Polyacrylonitrile | 2.2:1 | 60% | 100% |
| Acrylonitrile-Butadiene Styrene Terpolymer | 1.5:1 | 60% | 35% |
| Polyvinyl Chloride | 1.5:1 to 2.5:1 | 50–60% | 7–15% |
| Satisfactory Films | | | |
| Propylene-Ethylene Copolymer | 5:1 to 6:1 | 50–100% | 100–250% |
| Polyamide (Nylon) | 2:1 to 3:1 | 150% | 150–200% |
| Polyethylene Terephthalate | 4:1 | 100% | 50–300% |
| Unacceptable Films | | | |
| Low Density Polyethylene | 7.5:1 to 15:1 | 30–150% | 200–500% |
| Polyethylene Ionomer | 5:1 to 6:1 | 50–80% | 200–500% |
| Ethylene-Vinyl Acetate Copolymer | 8:1 | 20–50% | 400–500% |

*With-Grain to Cross-Grain

As may be seen from the data in Table 1, the most desirable films, such as high density polyethylene, exhibit, as a necessary combination of physical characteristics, a relatively high tensile strength ratio and a maximum elongation in each direction of 150% or less. The preferred high density polyethylene sheet, after subjection to the highest degree of uniaxial orientation reasonably attainable, has a tensile strength ratio (with-grain to cross-grain) of greater than 4 to 1 and generally between 5 to 1 and 6.5 to 1, a maximum with-grain elongation of from 20 to 100% and preferably from 30 to 75%, and a maximum cross-grain elongation of from 20 to 100% and preferably between 20 and 50%. Other desirable and satisfactory films show tensile and elongation values within the limits previously stated as acceptable.

It will be further noted from the data in Table 1, that the films which are unacceptable for use in this invention show a maximum cross-grain extensibility substantially greater than 150%, which was previously stated as being the maximum satisfactory level. Films such as low density polyethylene (density below about 0.93), even when subjected to the highest reasonably attainable degree of uniaxial orientation, are too "stretchy" or extensible to tear readily along the axis of orientation upon the application of tear force at the edge of the film sheet. The high level (200–500%) of maximum extensibility thus precludes this and similar films from use in this invention, even though the tensile strength ratio is very favorable and well within the desired range.

In the tearing of the tear strip, and particularly in starting the tearing of the film component, it is important that the tearing stresses be concentrated at the location where the tear is to be initiated. Thus it is important that film underlying paperboard areas adjacent the tear strip be substantially fixed laterally, in addition to affixation on the tear strip, at the time of tearing so that they are unable to transfer away from the tear strip area substantial portions of the tear force. In the illustrated embodiment, the confinement of the film between the inner and outer paperboard panels, in combination with the overall rigidity of the product-filled package and the interfacial attraction between the product and the film, is sufficient to provide the necessary affixation.

In some embodiments of this invention the film forming part of the tear strip may not be called upon to serve the dual purpose as a release film. In those cases, the lateral affixation may be provided by the uniaxially oriented film being firmly attached about the interfacial surfaces of the film and the paperboard; whereupon an overall surface-to-surface lamination becomes a highly desirable and functional structure. Such structures take on the tear characteristics of the film. Starting cuts and lines of weakness may be preferred in the paperboard. But these serve primarily as cosmetic functions to the user, as discussed earlier. They indicate the desired location of tearing, and serve to confine tears in the outer surface of the paperboard to maintain its orderly appearance. They are not, however, necessary to the invention.

In the laminated structure, as in the structure illustrated in the drawings, it is critical that the paperboard be outwardly of the package relative to the oriented polymer film, in order to ensure tearing of the entire thickness of the tear strip. It is unsatisfactory to have the oriented polymer film disposed outwardly of the paperboard. Such structure results in removal of only part of the thickness of the paperboard by internal separation of the tear strip into a thickness of paperboard adhered to, and removed with, the film strip, and a thickness of paperboard remaining in place at the tear strip. Using such structure, the tear strips cannot be relied upon to open the cartons. It is entirely satisfactory to have additional layers of coatings, films, sheets and the like outwardly of the paperboard, so long as they are susceptible to displacement as part of the tear strip defined by the combination of the paperboard and the oriented polymer films.

Film 32 has been illustrated and described consistently herein as being oriented in the with-grain or machine direction. One could, of course, uniaxially orient the film in the cross-machine direction and obtain similarly useful film. Its orientation in the package would continue the same regarding the with-grain versus cross-grain direction of the orientation relative to the remainder of the package structure. This would, however, shift the machine direction and transverse direction by 90° due to the change in orientation direction. This not withstanding, the transversely oriented film would be the functional equivalent of film oriented in the machine direction. Transverse orientation could, of course, control the acceptability of a given polymer according to the Table 1 description.

It is to be understood that the constructions specifically described herein are intended to be illustrative of the present invention without being restrictive, and reference should be made to the appended claims in determining the scope of the invention.

Having thus described the invention, what is claimed is:

1. An easily opened paperboard carton construction, comprising:

a front wall, a bottom wall, a rear wall, opposed end walls and a top cover panel hingedly attached along one edge to the upper edge of the rear wall and having a front cover panel hingedly attached to the opposite edge of said top cover panel and overlapping the upper portion of the front wall when the carton is erected, said front cover panel having a pair of parallel weakness lines spaced from a free edge of said front cover panel and defining a tear strip, said free edge being adherent to said front wall;

a release liner for said top cover panel, comprising uniaxially oriented polymer film affixed along one edge thereof to the interior surface of said rear wall, said film extending to substantially completely cover the interior surface of said top cover panel and being affixed to the inner surface of said front cover panel in the region thereof between said weakness lines, said film being uniaxially oriented to the extent that it exhibits tensile strength in the orientation direction that is substantially greater than the tensile strength in the direction perpendicular to the orientation direction, said film having a with-grain to cross-grain tensile stength ratio greater than 1.5 to 1 and a maximum elongation in both with-grain and cross-grain directions of no more than 150%; and the with-grain direction of said film being substantially aligned with said weakness lines, and said film extending along the entire length of the tear strip region to which it is affixed, thereby strengthening the tear strip to facilitate its complete removal, and ensuring tearing of the tear strip along said weakness lines, preparatory to hingedly opening said top cover panel.

2. The carton of claim 1, wherein said film terminates in a linear edge substantially coincident with the one of said weakness lines closest to said free edge of said front cover panel.

3. The carton of claim 1 or 2, wherein said film is affixed by adherence to said front cover panel throughout the entire extent of the region between said weakness lines.

4. An easily opened paperboard carton construction, comprising:

a bottom wall, and upstanding side walls including at least front and rear wall portions, a top cover panel hinged on the rear wall portion and having a front cover panel hinged thereon and overlapping the upper portion of the front wall portion, said front cover panel having a pair of parallel weakness lines spaced from a free edge of said front cover panel and defining a tear strip, said free edge being adherent to said front wall portion;

a release liner for said top cover panel, comprising uniaxially oriented polymer film affixed along an edge thereof to the interior surface of said rear wall, said film extending to substantially completely cover the interior surface of said top cover panel and being affixed to the inner surface of said front cover panel in the region thereof between said weakness lines, said film being uniaxially oriented to the extent that it exhibits tensile strength in the orientation direction that is substantially greater than the tensile strength in the direction perpendicular to the orientation direction, said film having a with-grain to cross-grain tensile strength ratio greater than 1.5 to 1 and a maximum elongatiom in both with-grain and cross-grain directions of no more than 150%; and the with-grain direction of said film being substantially aligned with said weakness lines, and said film extending along the entire length of the tear strip region to which it is affixed, thereby strengthening the tear strip to facilitate its complete removal, and ensuring tearing of the tear strip along said weakness lines, preparatory to hingedly opening said top cover panel.

5. The carton of claim 4, wherein said film terminates in a linear edge substantially coincident with the one of said weakness lines closest to said free edge of said front cover panel.

6. The carton of claim 4 or 5, wherein said film is affixed by adherence to said front cover panel throughout the entire extent of the region between said weakness lines.

* * * * *